United States Patent [19]

Wuermli

[11] Patent Number: 4,509,230

[45] Date of Patent: Apr. 9, 1985

[54] DRAFTING MECHANISM FOR A SPINNING MACHINE

[75] Inventor: Arthur Wuermli, Winterthur, Switzerland

[73] Assignee: Rieter Machine Works Ltd., Winterthur, Switzerland

[21] Appl. No.: 509,235

[22] Filed: Jun. 29, 1983

[30] Foreign Application Priority Data

Jul. 23, 1982 [CH] Switzerland ..... 4503/82

[51] Int. Cl.[3] ..... D01H 5/64

[52] U.S. Cl. ..... 19/245; 19/262

[58] Field of Search ..... 19/244, 245, 248, 249, 19/252, 262

[56] References Cited

U.S. PATENT DOCUMENTS

| | | | |
|---|---|---|---|
| 2,180,325 | 11/1939 | Toenniessen | 19/245 |
| 2,382,214 | 8/1945 | Dunleavy | 19/245 X |
| 2,593,478 | 4/1952 | Newton | 19/262 X |
| 2,774,995 | 12/1956 | Sandelin | 19/248 |
| 3,310,845 | 3/1967 | Pitts et al. | 19/245 |

FOREIGN PATENT DOCUMENTS 908590 4/1954 Fed. Rep. of Germany .

2217314 10/1973 Fed. Rep. of Germany .

*Primary Examiner*—Louis K. Rimrodt

*Attorney, Agent, or Firm*—Werner W. Kleeman

[57] ABSTRACT

A drafting mechanism for a spinning machine containing a preliminary drafting zone and a main drafting zone is cleaned. There is provided an infeed roller pair comprising an upper roller and a lower roller, an exit or delivery roller pair comprising an upper roller and a lower roller, and an upper apron and a lower apron driven by an apron roller pair. The preliminary drafting zone extends between the infeed roller pair and the nip line formed by the apron rollers pressed against the upper and lower aprons, and the main drafting zone extends between this nip line and the exit roller pair. The lower apron extends beneath the preliminary drafting zone and the lower infeed roller. During operation of the drafting mechanism the lower apron is in grazing or wiping contact with the lower one of the infeed rollers. There is thus attained cleaning of the lower infeed roller and the lower apron without requiring special means for such cleaning. As a surprising result, substantially automatic threading-up of the drafting mechanism and recycling of fibers resulting from the cleaning operation are achieved.

9 Claims, 1 Drawing Figure

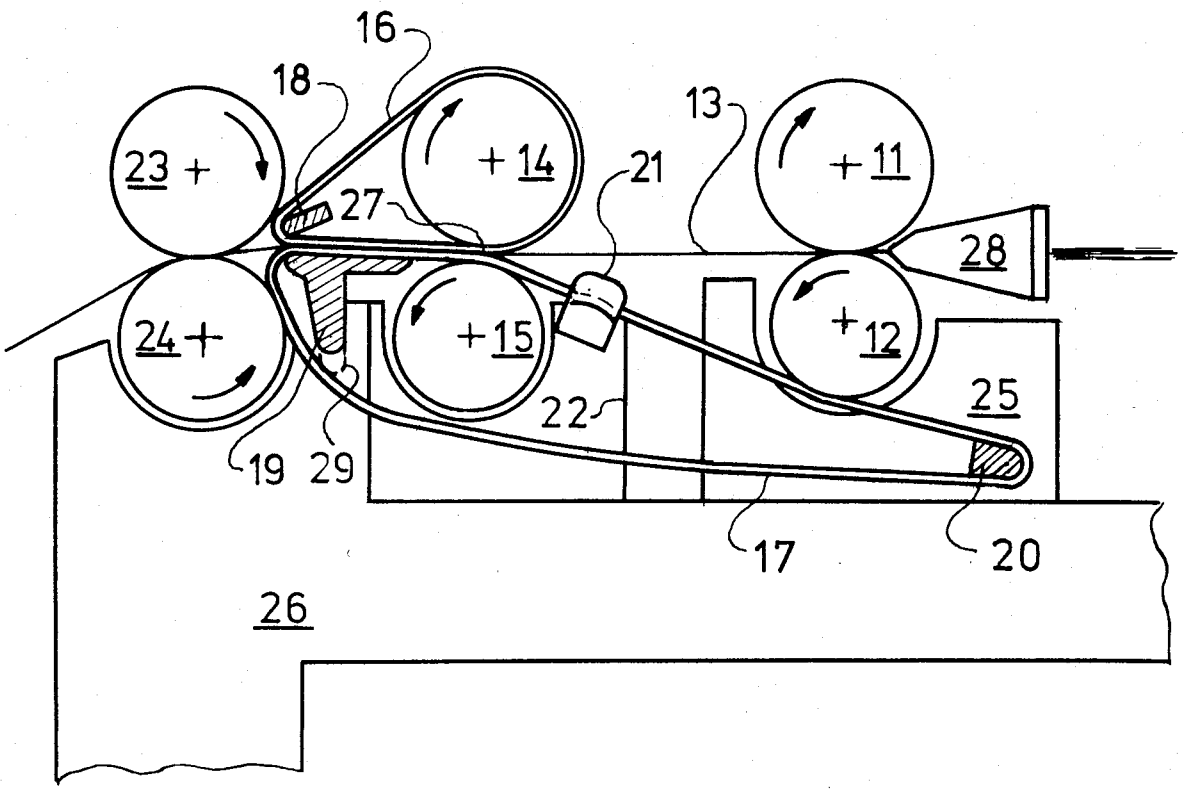
11
12
13
14
15
16
17
18
19
20
21
22
23
24
25
26
27
28
29

DRAFTING MECHANISM FOR A SPINNING MACHINE

BACKGROUND OF THE INVENTION

The present invention relates to a new and improved drafting mechanism for a spinning machine containing a preliminary drafting zone and a main drafting zone.

In its more specific aspects, the drafting mechanism or arrangement of the present development is of the type containing an infeed roller pair comprising an upper infeed roller and a lower infeed roller, an exit or delivery roller pair comprising an upper delivery roller and a lower delivery roller, and an upper apron and a lower apron driven by an apron roller pair. The preliminary drafting zone extends between the infeed roller pair and the nip line formed by the apron rollers pressed against the upper and lower aprons, and the main or primary drafting zone extends between this nip line and the exit roller pair. The lower apron extends beneath the drafting zone and the lower infeed roller.

The present invention is concerned in particular with the cleaning of such drafting mechanisms or arrangements.

From German Published Patent Application No. 2,217,314 a cleaning device is already known to the art in which a cleaner belt is specifically provided for the purpose of cleaning and a friction and deceleration effect is achieved through friction and movement of the cleaner belt on the more rapidly rotating rollers and on the upper apron.

Also, from German Patent No. 908,590 there is known an apron drafting mechanism in which the lower apron extends to a location underneath the infeed cylinder pair. There is no contact of the lower apron with the lower one of these cylinders or rollers.

SUMMARY OF THE INVENTION

It is a primary object of the present invention to provide a new and improved construction of a drafting mechanism or arrangement for a spinning machine, wherein there is reliably and efficiently obtained cleaning of the lower apron and the lower infeed roller or cylinder.

A further significant object of the present invention is directed to a new and improved drafting mechanism for a spinning machine wherein the lower apron is constructed and arranged to coact with the lower one of the infeed rollers or cylinders such that there is positively and reliably achieved, in a most efficient manner, cleaning of such lower apron and the lower infeed roller or cylinder.

Now in order to implement these and still further objects of the invention, which will become more readily apparent as the description proceeds, the drafting mechanism or arrangement of the present development is manifested by the features that, during operation of the drafting mechanism the lower apron is in grazing or wiping contact with the lower infeed roller or cylinder of the pair of infeed rollers.

In accordance with the invention, cleaning of the lower infeed roller or cylinder and the lower apron is obtained through rubbing of their surfaces, no special cleaning means being necessary. The drafting mechanism or arrangement is therefore very simple in its design and construction. Through the continuous cleaning of the roller, the danger of lap formation is considerably reduced. Adhesion of fibers is already prevented during the starting phase. Because the upper and lower aprons serve to guide the fibers during the drafting operation in the main or primary drafting zone, and because in operation the aprons are guided around deflecting or diverter locations, it is already necessary to manufacture the aprons from a material resistant to friction. Insofar as, in general, only a slight contact of the lower apron with the lower infeed roller is produced, the longevity or service life of the apron is practically unaltered by the cleaning arrangement.

Additionally, the drafting mechanism or arrangement according to the invention provides the surprising result of a substantial simplification of the threading-up operation, because the roving end moved through the infeed roller pair during threading-up no longer has to be manually guided to the infeed location of the nip region formed by the aprons. With an arrangement according to the invention, the roving automatically comes into contact with the lower apron, therefore is carried along or entrained by the latter and passes into the region of mutual contact of the moving aprons in order to be transported further. Since the fibers resulting from the cleaning operation fall onto the lower apron, the invention provides the further advantage of reincorporation of the stripped-off fibers into the roving to be drafted in the main drafting zone, that is to say there results a recycling of the fibers resulting from the cleaning operation.

BRIEF DESCRIPTION OF THE DRAWINGS

The invention will be better understood and objects other than those set forth above, will become apparent when consideration is given to the following detailed description thereof. Such description makes reference to the annexed drawing wherein the single FIGURE of the drawing schematically illustrates in side and partially sectional view a drafting mechanism or arrangement for a spinning machine and constructed according to the teachings of the present invention.

DETAILED DESCRIPTION OF THE PREFERRED EMBODIMENTS

Describing now the drawing, it is to be understood that for purposes of simplifying the illustration thereof there has only been shown enough of the exemplary embodiments of inventive drafting mechanism or arrangement for a spinning machine as needed for those skilled in the art to readily understand the underlying principles and concepts of the present development. Turning attention now to such single FIGURE of the Drawing, the same shows an infeed roller pair 11, 12 formed by an upper infeed roller 11 and a lower infeed roller 12 by means of which the sliver 13 or the like entering through the condensor 28, or the incoming roving or the like, is grasped at the infeed side of the drafting mechanism or arrangement and is transported from the right to the left as viewed in the FIGURE. Thereafter, upper and lower apron rollers 14 and 15, respectively, are provided which form an apron roller pair 14, 15. This apron roller pair 14, 15 serves to drive the upper apron 16 and the lower apron 17. The apron 16 is guided around a deflection or diverter element 18 defining a deflection or diverter location. Correspondingly, for guiding of the apron 17, a bridge-piece 19 or equivalent structure and a deflection or diverter rail 20 are provided. The two aprons 16, 17 are followed by an exit or delivery roller pair 23, 24 formed by an upper exit or delivery roller 23 and a lower exit or delivery roller 24.

An apron guide or guide means 21 is secured to a bearing or support saddle 22. The latter primarily serves for carrying the lower apron roller or roll 15. It is advantageously conveniently adjustable in a direction which is perpendicular or normal to the rotational axis of the roller 15. This adjustment serves for adaptation of the spacing between the infeed location for the sliver fibers (formed by the approaching aprons 16, 17) and the exit or delivery rollers 23, 24 to the various types of such fibers which are processed, that is to say, for adaptation of the length of the main or primary drafting zone. The bearing or support saddle 22, and the additional bearing or support saddle 25 for the infeed roller 12, are carried by a suitable support or carrier 26.

The location of maximum pressure, formed by the rollers 14 and 15 which are pressed against one another, is located between the aprons 16, 17 along a line extending substantially parallel to the rotation axes of the rollers 14, 15, the so-called nip line 27. The region between the infeed roller pair 11, 12 and the nip line 27 is the preliminary drafting zone. The region between the nip line 27 and the exit or delivery roller pair 23, 24 is the main or primary drafting zone.

During operation of the drafting mechanism or arrangement, the rollers or rolls 11, 12, 14, 15 and 23, 24 rotate in the direction indicated by their associated arrows. The circumferential speed or velocity of the infeed rollers 11, 12 and of the apron rollers 14, 15 is relatively small, the circumferential speed or velocity of the infeed rollers 11, 12 being somewhat lower than that of the apron rollers 14, 15, and thus, also than the speed or velocity of the aprons 16, 17. Thus, a light drafting of the sliver 12 is obtained in the preliminary drafting zone. The circumferential speed or velocity of the rollers 23, 24 is, however, much greater than that of the rollers 14, 15, so that the effective drafting of the sliver or the like occurs in the main drafting zone or region.

In accordance with the invention, the rollers 11, 12 and 14, 15 and the deflector or diverter rail 20 are arranged in such a manner that, during operation of the drafting mechanism, the lower apron 17 is in contact with the lower infeed rollers 12, that is to say, it grazes or slightly wipingly contacts the lower roller 12. It is clear that at the location of such contact the surfaces of the lower roller 12 and of the lower apron 17 are moving in opposite directions. Fibers adhering to the lower roller 12 are thereby stripped-off by the apron 17 and remain lying upon the latter. They thus again pass into the fiber sliver 13 with which they are blended or mixed during further processing thereof.

A second embodiment of the invention is also shown in the FIGURE. In accordance therewith, contact of the lower apron 17 with the lower exit or delivery roller 24 is additionally obtained by providing a corresponding mutual arrangement of the bridge-piece 19 or equivalent structure and the exit or delivery roller 24. Also in this case, the surface of the lower exit or delivery roller 24 moves in the opposite direction to the movement of the lower apron 17 at the contact location. In this manner, cleaning of the lower exit or delivery roller 24 is beneficially obtained.

Through the drawing effect of the rollers 14, 15 upon the lower apron 17, and as a result of the friction thereof on the deflection or diverter rail or rail means 20, the lower apron 17 is in a tensioned condition between the apron rollers 14, 15 and the rail or rail means 20 and for this reason is pre-tensioned against the lower roller 12 during operation of the drafting mechanism or arrangement. On the other hand, the lower run of the lower apron 17 located between the parts 19 and 20 is in a loose condition. Pressing thereof against the lower exit or delivery roller 24 is a result of the natural stiffness or rigidity of the lower apron 17.

If a firmer contact against the exit or delivery roller 24 is required, this can be achieved in a simple manner by means of a further embodiment. In accordance therewith, the part of the bridge-piece 19 extending downwardly is provided with a corresponding extension or prolongation 29 as indicated in dotted lines. Through appropriate choice of the form of the extension or prolongation 29, the desired firmness of the contact of the lower apron 17 against the roller 24 can be selected as desired.

It is clear that during threading-up of the sliver 13 or the like, in the event that the latter hangs downwardly in an undesired manner after passage between the infeed rollers 11, 12, it must rest upon the lower apron 17, and thus, must be taken-up or entrained by the latter and thereby must subsequently pass between the aprons 16, 17. For this reason there surprisingly results the initially mentioned advantage of a substantially automatic threading-up operation.

In a further embodiment of the present invention, the apron guide 21 is provided for lateral guidance of the apron 17. The use of a loose apron 17 produces less friction, and thus, an increase in the life span or service life thereof. Through the use of the apron guide 21, drifting of the loose apron is prevented, and thus, trouble-free operation of the drafting mechanism or arrangement is assured.

Very precise guiding of the apron 17 is obtained if the apron guide 21 is located as close as possible to the infeed location of the nip region of the aprons 16, 17. Thus, with a loose lower apron 17, a further advantageous embodiment of the invention is obtained in that the apron guide 21 is secured to the bearing or support saddle 22. In this case, the apron guide 21 is also moved during horizontal adjustment of the rollers 14, 15 to various fiber types (particularly fiber lengths) achieved by shifting of the bearing or support saddle 22. A previously set, optimum spacing of the rollers 14, 15 from the apron guide 21 is thus always retained during adaptation to various fiber types.

While there are shown and described present preferred embodiments of the invention, it is to be distinctly understood that the invention is not limited thereto, but may be otherwise variously embodied and practiced within the scope of the following claims.

Accordingly, what I claim is:

1. A drafting mechanism for a spinning machine provided with a preliminary drafting zone and a main drafting zone comprising:

an infeed roller pair comprising an upper infeed roller and a lower infeed roller;

a delivery roller pair comprising an upper delivery roller and a lower delivery roller;

an apron roller pair comprising an upper apron roller and a lower apron roller;

an upper apron and a lower apron driven by said apron roller pair;

the preliminary drafting zone extending between the infeed roller pair and a nip line formed by the apron rollers which are pressed against the upper and lower aprons;

the main drafting zone extending between said nip line and the delivery roller pair;

said lower apron extending beneath the preliminary drafting zone and the lower infeed roller; and the lower apron being in grazing contact with said lower infeed roller during operation of the drafting mechanism in order to clean the lower infeed roller of fibers.

2. The drafting mechanism according to claim 1, wherein:

the lower apron is positioned for grazing contact with the lower delivery roller during operation of the drafting mechanism.

3. The drafting mechanism according to claim 2, wherein:

the lower apron is structured to possess a predetermined stiffness; and the lower apron is loose and is in contact with the lower delivery roller as a result of its stiffness.

4. The drafting mechanism according to claim 2, wherein:

the upper and lower aprons form a nip region having an exit location;

a bridge-piece provided at the exit location of the nip region for guiding the lower apron; and the bridge-piece is provided with an extension for guiding the lower apron and which causes contact of the lower apron with the lower delivery roller.

5. The drafting mechanism according to claim 1, wherein:

the lower apron is loose; and a lateral apron guide provided before an infeed location to a nip region formed between the upper and lower aprons.

6. The drafting mechanism according to claim 5, further including:

a bearing saddle carrying the lower apron roller and to which there is secured the apron guide.

7. The drafting mechanism according to claim 1, further including:

a condenser arranged rearwardly of the infeed roller pair.

8. A drafting mechanism for a spinning machine provided with a preliminary drafting zone and a main drafting zone comprising:

an infeed roller pair comprising an upper infeed roller and a lower infeed roller;

a delivery roller pair comprising an upper delivery roller and a lower delivery roller;

an apron roller pair comprising an upper apron roller and a lower apron roller;

an upper apron and a lower apron driven by said apron roller pair;

the preliminary drafting zone extending between the infeed roller pair and a nip line formed by the apron rollers which are pressed against the upper and lower aprons;

the main drafting zone extending between said nip line and the delivery roller pair;

said lower apron extending beneath the preliminary drafting zone and the lower infeed roller;

the lower apron being in grazing contact with said lower infeed roller during operation of the drafting mechanism in order to clean said lower infeed roller of fibers; and the lower apron is loose.

9. The drafting mechanism according to claim 8, further including:

a lateral apron guide provided before an infeed location to a nip region formed between the upper and lower aprons.

* * * * *